US005391064A

United States Patent [19]

Lopez

[11] Patent Number: 5,391,064

[45] Date of Patent: * Feb. 21, 1995

[54] FRAME INDEPENDENT ELECTRIC BLOWER HALF-HOUSING

[76] Inventor: Robert Lopez, 1219 S. Bonview Ave., Ontario, Calif. 91761

[ * ] Notice: The portion of the term of this patent subsequent to Jul. 6, 2010 has been disclaimed.

[21] Appl. No.: 967,677

[22] Filed: Oct. 26, 1992

Related U.S. Application Data

[63] Continuation-in-part of Ser. No. 699,908, May 14, 1991, Pat. No. 5,224,844.

[51] Int. Cl.[6] ..... F04B 17/00

[52] U.S. Cl. ..... 417/423.14; 285/237

[58] Field of Search ..... 417/423.1, 423.14; 285/237

[56] References Cited

U.S. PATENT DOCUMENTS

| | | | |
|---|---|---|---|
| 3,722,924 | 3/1973 | Bjornsen | 285/237 |
| 4,950,133 | 8/1990 | Sargent | 417/423.14 |
| 4,978,281 | 12/1990 | Conger, IV | 417/423.14 |

FOREIGN PATENT DOCUMENTS

| | | | |
|---|---|---|---|
| 619966 | 10/1968 | Denmark . | |
| 2216678 | 1/1973 | Germany | 285/237 |

*Primary Examiner*—Richard A. Bertsch
*Assistant Examiner*—Alfred Baschas
*Attorney, Agent, or Firm*—Robert N. Schlesinger

[57] ABSTRACT

This invention relates to an in-line and frame independent electric blower half-housing, with cylindrical walls or essentially nonparallel interior walls constructed of an elastomeric material, and which is thereby acoustically silenced and is also easily disassembled for maintenance. The blower half-housing consists of one piece. The blower half-housing was designed for use in the spa industry, as an air blower, but has applications in other industries.

13 Claims, 7 Drawing Sheets

FRAME INDEPENDENT ELECTRIC BLOWER HALF-HOUSING

BACKGROUND—FIELD OF THE INVENTION

This is a continuation-in-part application of U.S. Pat. No. 5,224,844 (issued Jul. 6, 1993), Ser. No. 699,908, filed May 14, 1991, entitled: "Frame Independent Electric Blower Housing", also invented solely by Robert Lopez.

This invention relates to a frame independent electric blower half-housing, which may be mounted in-line, and which has essentially nonparallel interior walls, and which is thereby acoustically silenced and is also thereby easily disassembled for maintenance.

BACKGROUND—DESCRIPTION OF THE PRIOR ART

A primary application of this invention is to house the output end of electric blowers used in the spa industry, in an acoustically silenced housing with essentially nonparallel interior walls. The essentially, nonparallel interior walls of the blower half-housing may have a geometry which is spherical or the zone of a sphere, cylindrical, conical or a frustum of a cone, or a combination of these geometries. Nonparallel walls as cited throughout this specification and claims are comprised of the above geometries. Blowers used in the spa industry for blowing air, rather than another fluid, are sometimes referred to as aerators. Throughout this specification, the term "blower" is meant to also include the nearly synonymous term "aerator". Other applications for this invention include, but are not limited to blowers used in, e.g., air purification systems and the blowers used in various other industries.

Throughout this specification and its claims, the terms: housing, half-housing, enclosure, casing, and cover are meant to be generally synonymous; and although the term half-housing will be used, that term is intended to also mean housing, enclosure, casing, or cover. This invention most particularly relates to a blower half-housing, which may be defined as a housing which covers or holds the output end of the blower motor.

This blower half-housing invention is frame independent and is easily disassembled for removal of the motor and maintenance of the housing or the motor. This blower half-housing may be mounted in-line. The term "in-line", as cited throughout this specification and claims, means that the fluid or air flow travels straight through the blower, so as not to obstruct the fluid or, e.g., air. Other blowers in the industry make a curved, deflected, or 90 degree turn, and thereby do not provide a smooth, clear, and laminar flow, without turbulence or obstructions which may have a variety of mechanical and acoustic disadvantages.

The electric blower housings used in the spa industry have the disadvantage of being noisy and the vibration and flutter from this noise resonates throughout much of the spa, causing annoyance and discomfort to those using the spa. Thus, there is a need and a demand for an acoustically silenced or noise minimized electric blower housing.

Another disadvantage of the electric blower housings used in the spa industry, is that they require considerable effort and time to retrieve or replace the motor. The present invention solves many of these industry problems and is a significant advancement in the technology of housing blowers, i.e., motors, and particularly those used in the spa industry.

In trying to solve these disadvantages or problems, and within the scope of this objective, it was surprising to find that the present invention need not be comprised of a highly complicated design or of advanced materials, and that it need not be expensive or difficult to manufacture.

The objectives and advantages of this invention are:

1) The blower half-housing is frame independent and may be mounted in-line, without being bolted or mounted directly to the framework of the spa, or an independent framework supporting the blower housing. Other blowers are: a) frame dependent (bolted or mounted directly to the frame of the spa or to an independent framework and the housing itself is a part of such framework, extending throughout the spa system) and will thereby transmit vibration and noise throughout the spa via the framework, or are b) in-line and buried underground and are thereby difficult to service. The frame dependent blowers frequently use foam inserts to dampen the sound within the housing, which indicates that the manufacturer's of these blowers do not intend for the internal housing geometry to be an adequate inhibitor of noise. The blower housings typically used, e.g., in the spa industry, are made from such materials as metal or plastic, which tend to resonate and may tend to amplify acoustical noise.
2) The blower half-housing is structured so that one fastening member, e.g., a hose clamp, mounts the one-piece blower half-housing to the output fluid or air passageway, duct system, plumbing, tubing, or flow piping. The essentially synonymous terms: passageway, duct system, plumbing, tubing, and flow piping, is hereinafter referred to as "flow piping".
3) The blower half-housing is structured so that one fastening member, e.g., a hose clamp, mounts the one-piece blower half-housing to the cylindrical portion of the blower motor, such that the half-housing covers the output end of the blower motor. This use of one fastening member to hold the blower half-housing to the blower motor allows for easy mounting, assembly, and servicing of the blower motor.
4) The blower half-housing is air sealed, i.e., air tightly sealed, by means of fastening members, such as hose clamps. The air seal includes a fastening member sealing the opening provided for the electrical connection cord and for strain relief of the electrical connection cord. The output (or exhaust) opening are also each air sealed with a fastening members, such as a hose clamp. The blower half-housing is held in place and around the blower motor in an air sealed manner, through the use of another fastening member, such as a hose clamp. These fastening members prevent air escape or leakage at any orifice other than the intended air intake and output openings.
5) A preferred embodiment of the blower half-housing is constructed of neoprene (60/70 Shore) for noise insulation and for acoustically silencing the blower. The use of this elastomeric or polymeric material, such as neoprene 60/70 Shore, has the effect of further dampening the vibration and noise of the blower system, due to this material's elastomeric and porous material nature and its consequent sound absorbing qualities. The blower housings typically used in the spa industry are constructed of parallel metal or plastic walls. The present blower half-housing invention, however, utilizes its in-line positioning and the nonparallel interior walls of the half-housing to minimize acoustical waves emanating through the flow piping and to minimize the noise from the vibration and flutter from the motor. This means of reduction in the acoustical noise, vibration, and flutter, in the present invention does not create a reduction in the flow rate or function of the blower or the blower motor.

6) The blower half-housing may be removed, for servicing of the motor, by the unfastening of the fastening member around the portion of the half-housing covering the cylindrical portion of the blower motor. When a hose clamp is used as the fastening member, the blower half-housing may be opened for servicing of the motor, by the loosening of the hose clamp's one screw, rather than the numerous screws that are typically used to fasten other blower housings used in the spa industry.

7) The air flow (when the blower is, e.g., used in the spa industry, and used to blow air, rather than another fluid) is through a direct path and not through a curved, 90-degree, L-shaped, deflected, or "broken-off" path, as is commonly found in blowers used in the spa industry. This direct air flow path has mechanical as well as acoustical advantages over the less efficient, indirect or non-laminar flow paths for the fluid or air.

8) The blower half-housing is compact, but may efficiently accommodate a larger sized (or larger horsepower) motor, simply by having more of the larger motor protruding from the intake end of the half-housing.

9) The blower half-housing is not only directed to an improved blower housing with a reduced noise level and the various advantages listed above, but to its improved efficiency. This efficiency being a result of, e.g., the simple and economical manner in which the blower half-housing may be constructed, assembled and serviced, and to the fact that it is connected in-line with the flow piping and does not cause the flow of the fluid, e.g., air, to make a curved, 90 degree, L-shaped, deflected, or "broken off" path. This connection of the blower in-line with the flow path is not only an improved engineering design for the efficiency of the system and the work load on the blower motor, but is also significant in that there is a further noise reduction in the present invention due to this in-line flow, because the noise due to the essentially laminar air flow is significantly less than that found in other blowers where the flow is not as direct and smooth and may have considerable turbulence, and consequently, additional noise and vibration.

SUMMARY OF THE INVENTION

The present invention is an acoustically silenced, frame independent electric blower half-housing. This electric blower half-housing was invented by Robert Lopez. This electric blower half-housing is of particular utility in the spa industry, where the electric blowers blow fluids, usually air, through the flow piping, e.g., to the water-filled spa. It should be pointed out that blower motors used in the spa industry are often between a one horsepower and a three horsepower motor size, and these motors are of an often uniform size, such as those manufactured by Ametek's Lamb Electric Division. The motors used in the spa industry, however, may be more than the three horsepower size, and varying embodiments of the present invention may be used to house such varying sizes in the blower motor. This blower half-housing invention also has utility in other industries and in, e.g., air purification systems that use blowers.

This blower half-housing is frame independent and may be mounted in-line with the system's flow piping. The blower half-housing is acoustically silenced due to its internal wall configuration being of cylindrical or essentially nonparallel interior walls. The blower half-housing is further acoustically silenced due to the nonparallel walls being constructed of an elastomeric material or a polymeric material, such as neoprene 60/70 Shore, and the fact that the blower is frame independent and may be mounted in-line, so as to minimize the noise and resonance of the fluid flow through the flow piping, and the motor's vibration and flutter throughout the system, e.g., the spa.

The blower half-housing is comprised of one piece, which is held onto the blower motor in an air sealed manner through the use of a fastening member, such as a hose clamp. A fastening member is also used to air seal the housing to the output (or exhaust) flow piping. Another fastening member is used to air seal the electrical cable which powers the motor within the blower half-housing.

The blower half-housing may, e.g., be used for a one horsepower motor, when applied to the spa industry. When a larger motor, e.g., a one and one-half or two horsepower motor, is needed, the blower housing may accomodate such a larger motor simply by allowing more of the cylindrical intake end of the larger motor to protrude from the blower half-housing.

In a preferred embodiment of this invention, the fastening members are hose clamps and these hose clamps utilize one screw to form an air-seal and to hold the connected pieces together. The blower half-housing fits snug against or around the motor where the cylindrical (intake) portion of the motor may protrude from the blower half-housing, and is held onto the blower motor in an air sealed manner through the use of the fastening member, e.g., the hose clamp. This snug fitting of the blower housing against or around the cylindrical and largest dimension of the motor further minimizes the effects of the motor vibration and flutter, due to the elastomeric material composition of the blower half-housing acoustically silencing the vibration and flutter of the motor.

The blower half-housing is shaped so as to grip or hold the largest dimension (i.e., the cylindrical or canister portion) of the blower motor snug or tight through the use of a fastening means, such as a hose clamp.

Further objects, features, and advantages of the present invention will become more apparent from the following description when taken with the accompanying drawings which show, for purposes of illustration only, an embodiment construction in accordance with the present invention.

DRAWING FIGURES

The drawings reflect the best embodiment of the blower half-housing, as is intended for use in the spa industry, but is not limited to such use.

FIG. 1 shows an exploded isometric view of the blower half-housing, housing a blower motor, and illustrating the ease and order of assembly of the blower half-housing.

PIG. 2 shows an isometric side view of the blower half-housing as it would appear without a motor within it, and without the three fastening members.

FIG. 3 shows an isometric side view of the blower half-housing, shown here with a portion of the cylindrical (intake) end of a motor (5) protruding from the intake end (13) of the half-housing, the electrical connection to the motor protruding from the extended cable opening (6), and with a section of output piping protruding from the output (exhaust) end (7) of the half-housing, and when the three fastening members in this preferred embodiment are hose clamps.

Figure 6:
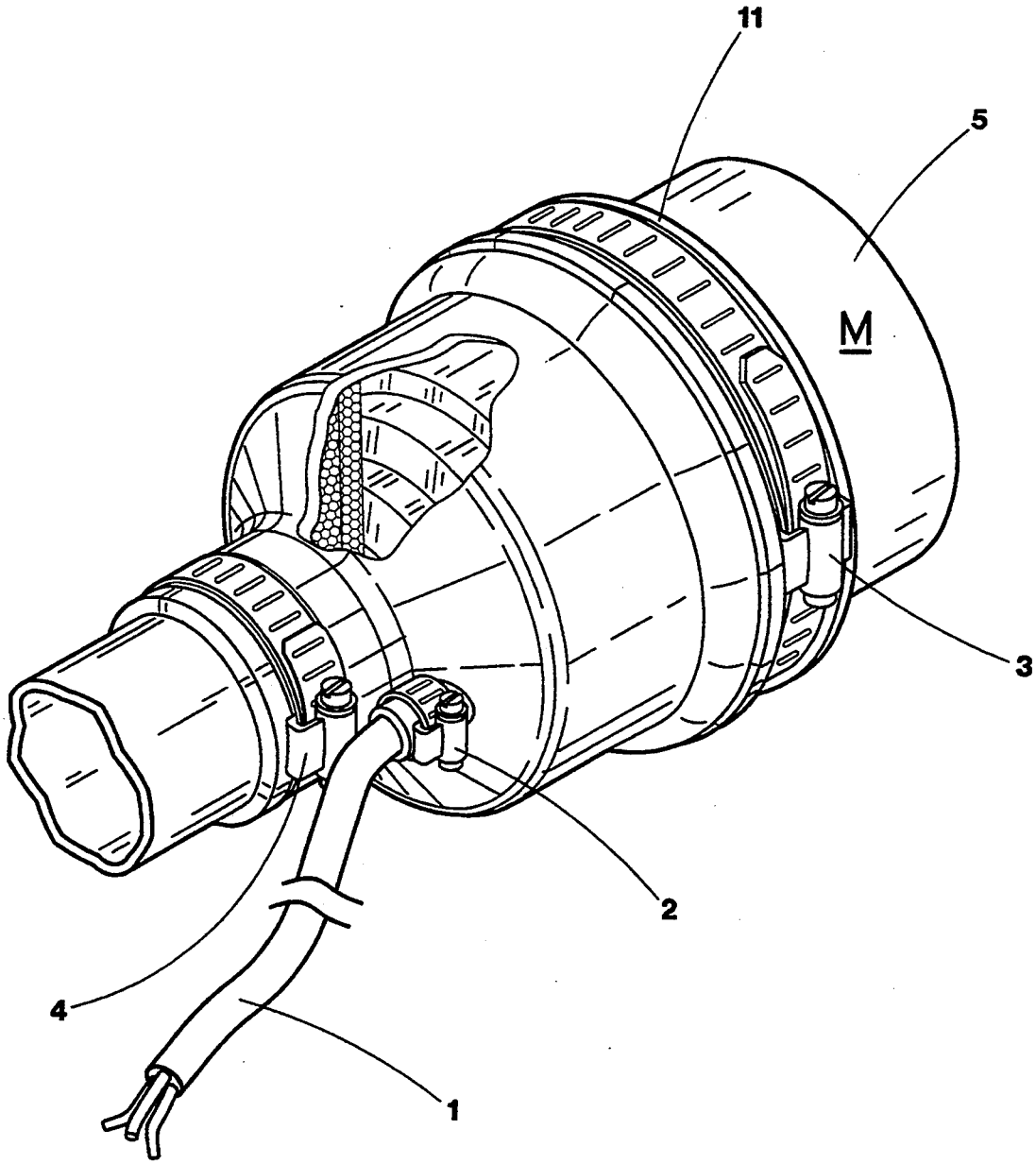

FIG. 6 shows an isometric view of the blower half-housing, housing a blower motor, and showing a cut-away section of the blower half-housing wall with an optional additional muffling or sound absorbing material incorporated into the interior of the half-housing; and, an optional muffler or sound dampening material may also be incorporated into the output flow piping or a muffler may be attached to a portion or the output flow piping to further silence the blower motor.

Figure 7:
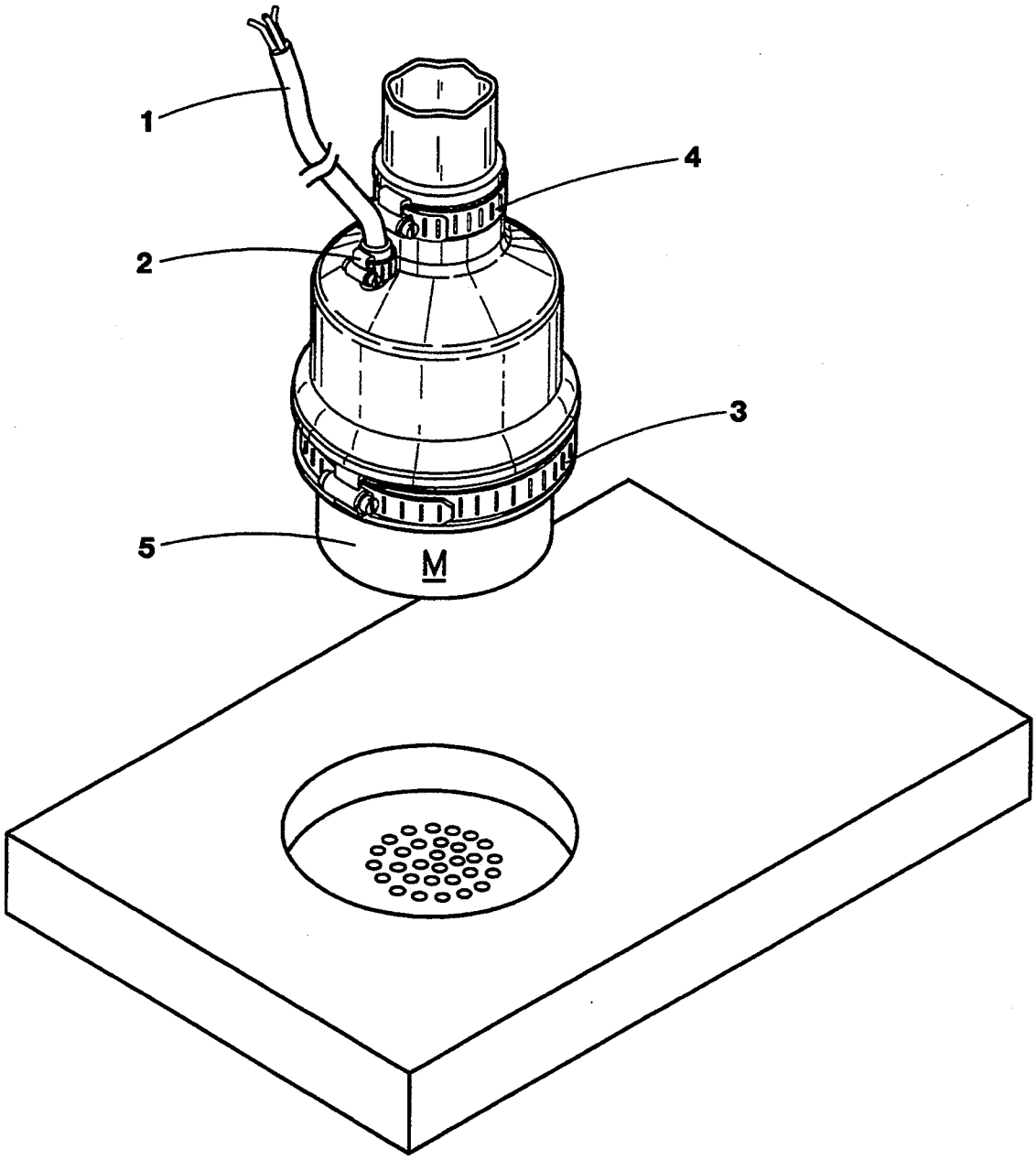

FIG. 7 shows an exploded isometric view of the half-housing with a blower motor intended to fit into a perforated receptical or fitting, in a spa or skid pack's floor or wall. Said perforations may be elliptical or slit-like rectangles, and there may be a screen, filter, or prefilter in between said receptical or fitting, and the blower motor's intake. There may also be a cup-shaped or canister-shaped covering or fitting over the exposed, cylindrical intake portion of the blower motor, which may also act as a filter or prefilter; this covering or fitting over the exposed, cylindrical intake portion of the blower motor is composed of a polymeric or elastomeric material, such as polyvinyl chloride, neoprene 60/70 shore, or a compatible plastic material.

REFERENCE NUMERALS IN THE DRAWINGS

Referring now to the drawing figures, like reference numerals are used to refer to like specific parts of the various Figures. The reference numerals used to describe the various parts of the Figures follows.

1. Electric Power Cable (1), for the blower motor (5).
2. Hose Clamp (2), securing the opening for the power cable (1), in an air tight seal.
3. Hose Clamp (3), securing the blower motor (5) to the blower half-housing, in an air tight seal.
4. Hose Clamp (4), securing output flow piping in place on the blower half-housing, in an air tight seal.
5. Electric Blower Motor (5), usually between one horsepower and three horsepower in the standard blower half-housing, when used in spas or their skid-packs.
6. Extended Cable Opening (6), for electric power cable (1).
7. Extended Output Opening (7), for holding in place the output flow piping.
8. Output Restraint Notch (8), for fitting and holding output flow piping in place.
9. Indented Output Fitting Area (9), for securing hose clamp (4) onto exterior part of blower half-housing and for holding the output flow piping in place within the fitting area.
10. Indented Housing Fitting (10), for fitting and securing blower motor (5) within the blower half-housing, through the use of a fastening means, such as a hose clamp (3).
11. Male Housing Restraint Notch (11), for further securing the fastening member, such as a hose clamp (3), around the intake portion of the blower half-housing, thereby further securing the blower motor within the blower half-housing, by preventing, through the use of the protruding male housing restraint notch (11), the hose clamp from slipping off from blower motor vibration and flutter.
12. Intake Restraint Notch (12), for fitting and holding the blower motor (5) into place in the blower half-housing.
13. Extended Intake Opening (13), for holding the intake end of the blower motor (5).

Referring now to the drawing figures, the reference numerals used to describe the various parts of the invention are shown in parenthesis following mention of the part in the text herein. Like reference numerals are used to refer to like specific parts in the various Figures.

Background and Description of the Pressurized Half-housing

A pressurized half-housing embodiment was discovered during the experimentation and testing of the blower housing for which this is a Continuation-in-Part Application; i.e., entitled: "Frame Independent Electric Blower Housing, invented and patented by Robert Lopez, U.S. Pat. No. 5,224,844, issued Jul. 6, 1993. This pressurized blower half-housing may also be used in the spa industry or in the air purification industry. It was found that the output (or larger) half of the above-cited and patented, full (two-piece) blower housing could house most of the blower motor (5). It was also found that the blower motor (5) and the half-housing could be pressure sealed through the use of: 1) the hose clamp (3) for securing and air-sealing the opening for the electric power cable (1), 2) the hose clamp (4) for securing and air-sealing the output flow piping in place, and 3) the hose clamp (3) for securing and air-sealing the output (or larger) half of the full blower housing around most of the largest cylindrical or canister section of the blower motor (5). It was found that the suction of the forced air through the blower created a positive seal, which further sealed the blower motor (5) within the blower half-housing.

Figure 3:
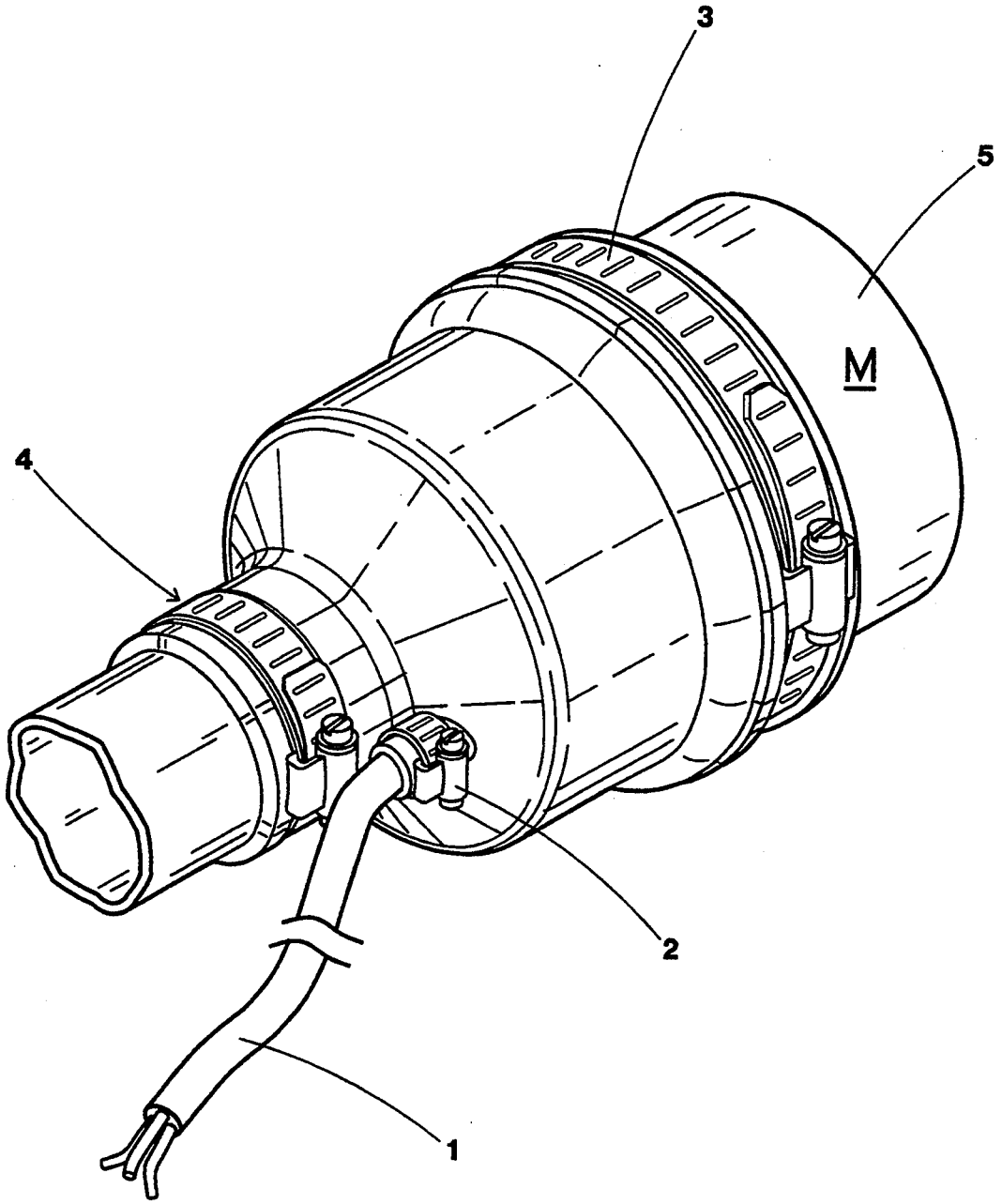
Figure 4:
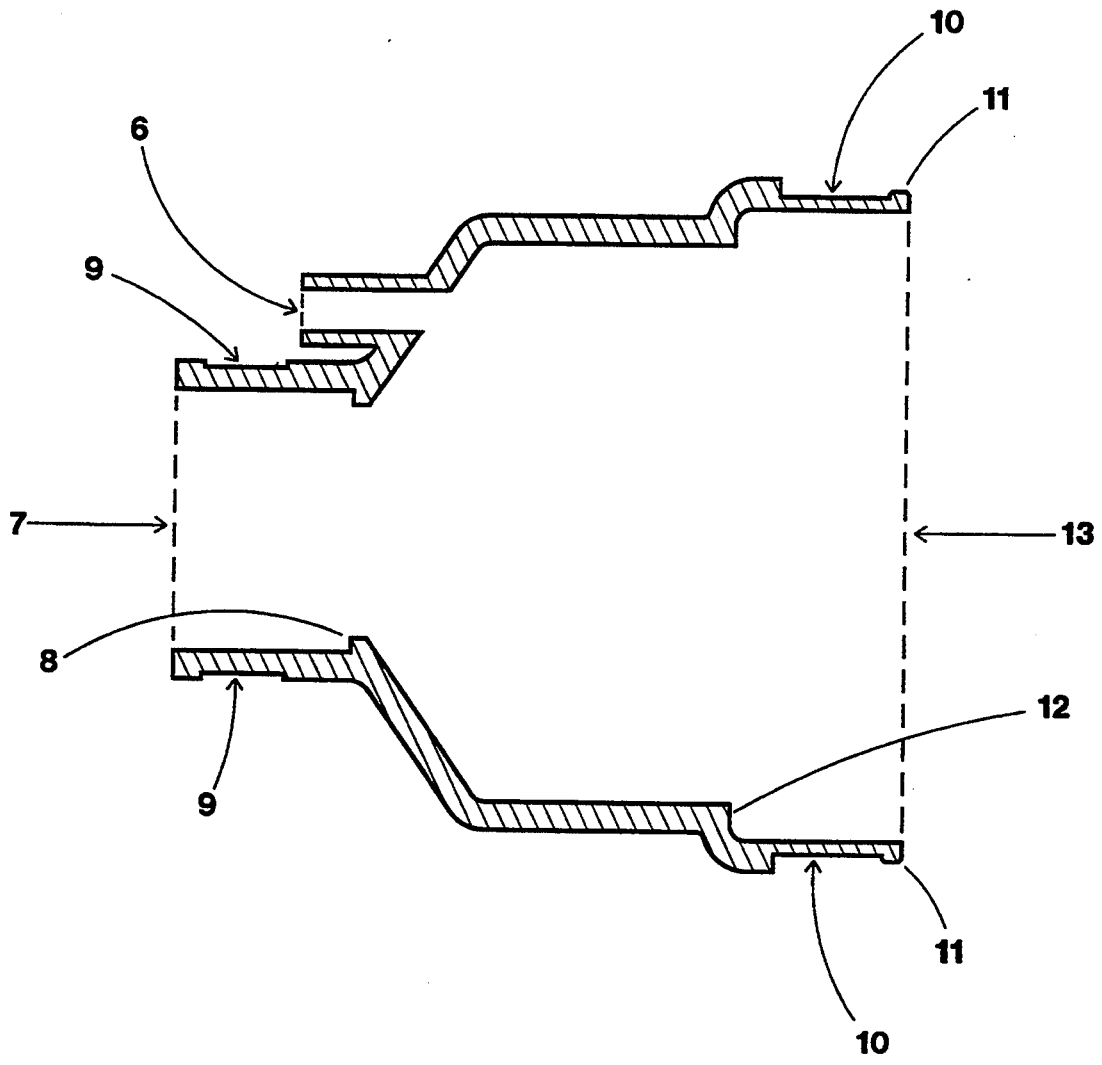
FIG. 4 shows a sectional side view of the blower half-housing as it would appear without a motor within it, and without the three fastening members.
Figure 5:
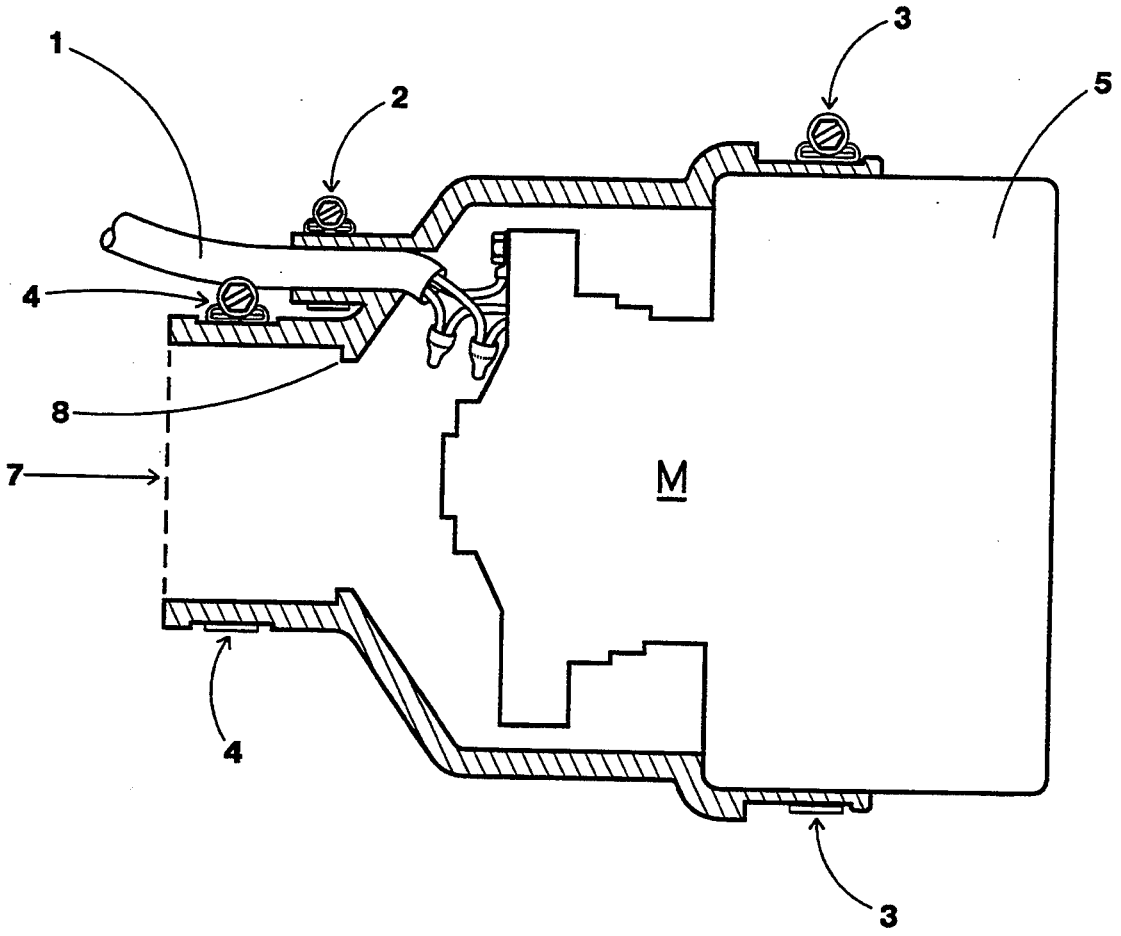
FIG. 5 shows a sectional side view of the blower half-housing as it would appear with a motor, and when the fastening members are hose clamps.

The use of only the output (or larger) half of the full blower housing for housing and sealing the output end of the blower motor (5) with the hose clamp (3), was found to provide the blower motor (5) with adequate acoustical silencing to make the use of this blower half-housing (e.g., FIG. 3) a cost efficient method of housing, silencing, and air-sealing the blower motor (5). This blower half-housing embodiment also has the advantage of not having any O-ring or glue seals. The air output piping is fastened, secured and air-sealed to the extended output opening (7) of the blower half-housing with a hose clamp (4), and there is no input piping to fasten or secure to the blower motor (5) or blower half-housing (FIG. 3). The power cable (1) is fastened, secured and air-seal ed using a hose clamp (2) and the blower half-housing (FIG. 3) is fastened, secured and air-sealed around most of the largest cylindrical or canister section of the blower motor (5) with a hose clamp (3). The hose clamp (3) is fit into and around the band-shaped indented housing fitting (10), and the hose clamp (3) is further secured into this fitting position by the male housing restraint notch (11), which may be a protruding band or notch around the outer perimeter of the indented housing fitting (10).

Figure 1:
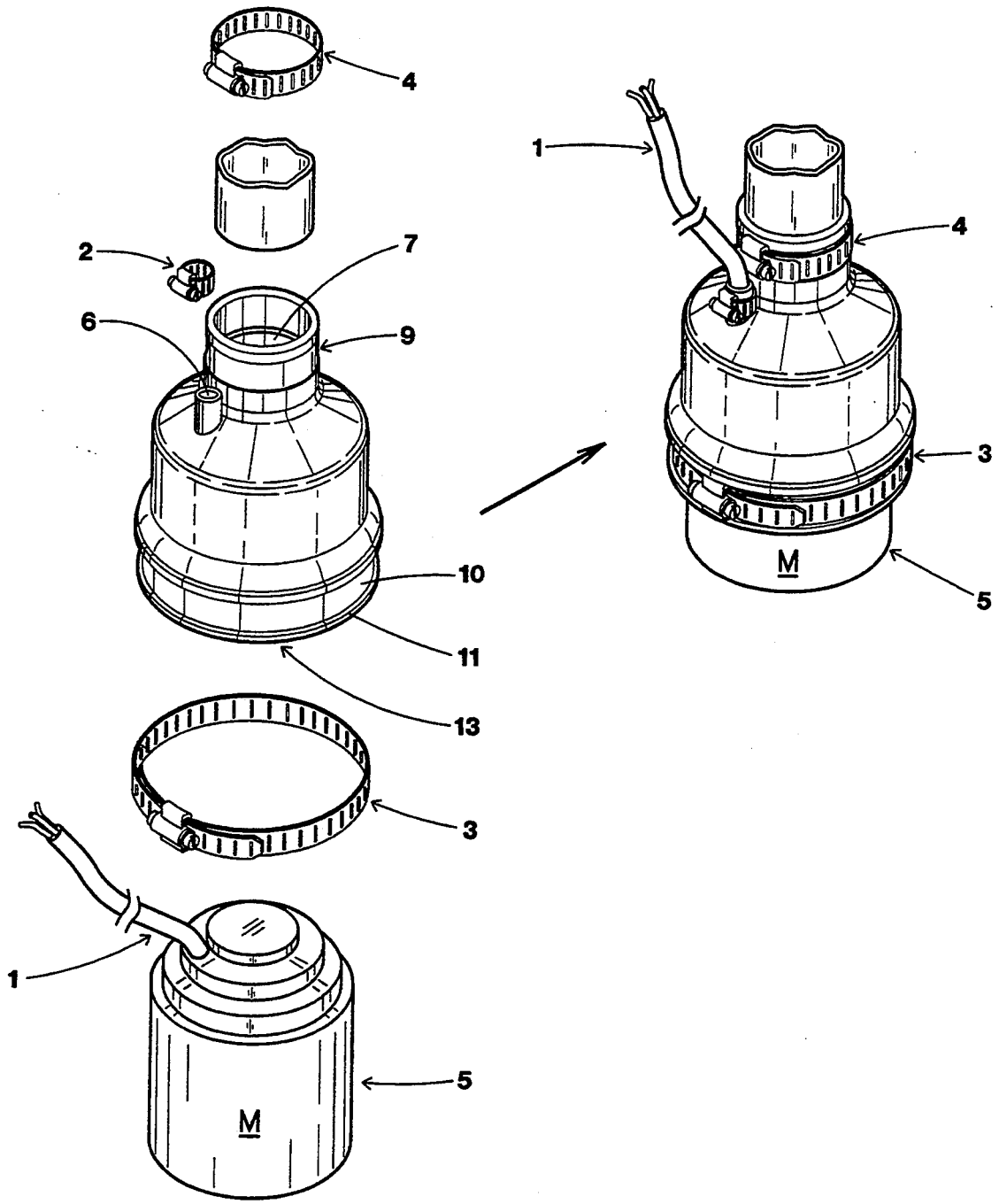
Figure 2:
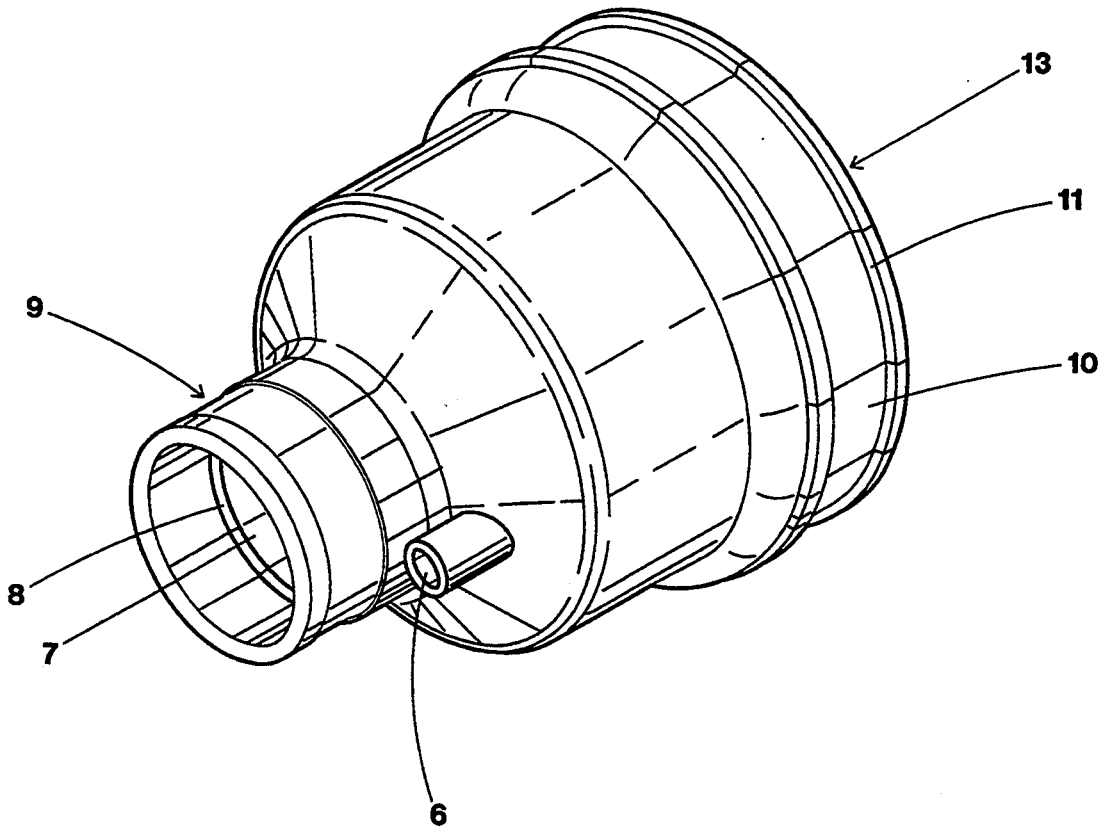

This blower half-housing embodiment may be more easily disassembled for service or replacement of the blower motor (5), because there are no glue-joints, and because the one screw on the hose clamp (4) for securing, fastening and air-sealing the blower half-housing (FIG. 3) around the largest cylindrical or canister section of the blower motor (5), loosens the band of the hose clamp (4), and allows the hose clamp (4) to be removed from the half-housing (FIG. 3), thereby allowing for a quicker removal of the blower motor (5). This blower half-housing embodiment also allows for a quicker assembly of the blower motor (5) into the blower half-housing (FIG. 1) because the are no glue-joints, and there are only the three hose clamp fittings to be fastened and air-sealed: 1) the hose clamp for the electric power cable (2), 2) the hose clamp for the output flow piping (4), and 3) the hose clamp for tightly gripping and air-sealing the output end and most of the cylindrical or canister section of the blower motor (5) within the blower half-housing (FIG. 1). The use of this blower half-housing embodiment by a manufacturer provides a cost savings in labor time, a stream-lining of the assembly process, a more efficient time-motion process in blower assembly, and a cost savings in materials by requiring only the output half of the full blower housing, thereby making the blower half-housing (FIG. 1) itself less expensive to manufacture. Blower motors have heretofore required a complete housing of the blower motor in order to avoid pressure leaks, which: 1) reduce the blower's efficiency and 2) increase its noise output.

This blower half-housing embodiment may be attached and air-sealed to the output flow piping in a number of positions, thereby facing the intake to the blower motor in a number of positions opposite that of the blower output. This blower half-housing embodiment may be positioned to receive air into its intake (13) from positions where the intake is facing upward, downward, or in a number of sideways or horizontal positions.

When the motor intake of the blower half-housing embodiment is desired in the upward position for pumping air to the various air injectors or air jets in a spa, the blower half-housing is attached with a hose clamp (4) to the air output flow piping, and such air output flow piping should be rigid enough to support the blower half-housing with the intake end of the blower motor (5) in an upward position, i.e., with the blower motor intake at the top, drawing-in air. The output flow piping travels downward initially and then travels in a circuit around the outside of the spa wall, where various T-joints on the circuit feed forced air through the various air injectors or air jets in the spa wall, and into the water-filled spa.

When the motor intake of this blower half-housing embodiment is desired in the downward position for pumping air to the various air injectors or air jets in a spa, the blower half-housing (FIG. 7) is attached with a hose clamp (4) to the air output flow piping and such air output flow piping should be rigid enough to hold the blower half-housing with the intake end of the blower motor (5) in a downward position, with the blower motor (5) intake on the bottom, drawing-in air (FIG. 7). The intake end of the blower motor (5) preferably would fit into a separate perforated receptical, through which the intake air would be forced by the blower motor (5), and which would preferably possess a screen or filter over the outside perforations of the receptical or within the receptical and over the perforations, for filtering the intake air and preventing undesired materials from entering the blower motor's (5) impeller or the air distribution system. The output flow piping travels upward initially and then travels in a circuit around the outside of the spa wall, where various T-joints on the circuit feed forced air through the various air injectors or air jets in the spa wall, and into the water-filled spa. The receptical which is holding the intake end of the blower motor (5) may be constructed of a flexible elastomeric or polymeric material such as, e.g., neoprene 60/70 Shore, and such an embodiment would have a hose clamp fitting area (10) and a hose clamp (3) to further fasten and secure the blower's intake end to the receptical.

When the motor intake of this blower half-housing embodiment is desired in a sideways or horizontal position for pumping air to the various air injectors or air jets in a spa, the blower half-housing is attached with a hose clamp (4) to the air output flow piping and such air output flow piping should be rigid enough to hold the blower half-housing with the intake end of the blower motor (5) in a sideways or horizontal position. The intake end of the blower motor (5) may preferably fit into a separate receptical with perforations on its side, through which the intake air would be forced by the blower motor (5), and which would preferably possess a screen or filter over the outside perforations of the receptical or within the receptical and over the perforations, for filtering the intake air and preventing undesired materials from entering the blower motor's impeller or the air distribution system. The output flow piping then travels in a circuit around the outside of the spa wall, where various T-joints on the circuit feed forced air through the various air injectors or air jets in the spa wall, and into the water-filled spa. The receptical which is holding the intake end of the blower motor (5) may be constructed of a flexible elastomeric or polymeric material such as, e.g., neoprene 60/70 Shore, and such an embodiment would have a hose clamp to further fasten and secure the blower's intake end to the receptical.

This blower half-housing embodiment is well suited for lower cost portable spas and spas which use skid packs, because of the utility and low cost of the blower half-housing (FIG. 7).

Description of Various Simple and Useful Embodiments

In simple, useful, and preferred embodiments of the blower half-housing, as shown in FIGS. 1 through 7, inclusive, the output end of a blower motor (5) is encased in the interior of the intake end of the blower half housing. The power cable (1) is held in place so as not to have any mechanical strain on the motor/power cable connection, and more importantly, is made air tight, i.e., air sealed by means of a fastening member, such as a hose clamp (2). An output restraint notch (8) prevents the output flow piping from being set too far or not far enough into the extended output opening (7) of the blower half-housing unit (e.g. , FIG. 5), and to allow a proper amount of output flow piping to be inserted into the blower half-housing unit (e.g., FIG. 1) to afford the hose clamp (4) a sufficient amount of output flow piping to grip and air seal the blower half-housing unit (FIG. 1).

The vibration and noise from the motor (5) in the present blower half-housing invention does not resonate through the system as much as with the blower housings that are mounted to the frame of the system or mounted to some other part of the system, where the vibrations may not only resonate, but may amplify the intensity of the vibrations, thereby causing considerable noise and vibration, and even damage to the system. This vibration of the system is likely to cause mechanical breakdown and failure in the system in a shorter period of time than, in systems not experiencing such vibration.

The blower half-housing unit (PIG. 4) is comprised of an elastomeric material or a polymeric material, e.g., neoprene 60/70 Shore, which has the effect of further dampening the vibration and noise of the blower system, due to its more porous and elastomeric material nature and sound absorbing qualities, than other materials used heretofore for blower housings in, e.g., the spa industry. Other blower housings are generally constructed of metal or plastic materials, which have a tendency to resonate and sometimes even amplify the vibration and noise of the system. The use of an elastomeric material or a polymeric material such as neoprene 60/70 Shore, in the construction of the blower housing (FIG. 1) also makes it easier to install and service the blower; e.g., it is easier to fit the motor (5) within the blower half-housing (FIG. 1), and to remove the motor (5) for replacement or service.

The blower half-housing unit (FIGS. 4 and 5) is generally constructed of cylindrical walls or essentially nonparallel interior walls, as described above, rather than the square or parallel interior walls found in other blower housings. These nonparallel interior walls may be comprised of a plurality of geometries that are spherical or the zone a sphere, cylindrical, or conical or a frustum of a cone, or a combination of these geometries, in a preferred embodiment. This shape of the interior walls may cause, in some embodiments, the housing itself to have a spherical, cylindrical, or conical shape, or in some other embodiments, a combination of these and other shapes. The effect of these essentially nonparallel interior walls is to further dampen or silence the vibration and noise of the system, particularly the noise emanating from the motor and resonating through the cavities or void spaces of the blower half-housing and the noise and acoustical waves being scattered about off of these interior walls and within the blower half-housing. The blower half-housing (FIG. 5) causes a noticeable decibel reduction and a reduction in the unpleasant tones and whistle-like sounds emanating from the blowers typically used in the spa industry.

Essentially nonparallel or cylindrical interior walls are meant to fit around much of the motor (5), and particularly the portions motor (5) with the largest circumference, which is often cylindrical or canister in shape, in a snug or tight fit, so as to reduce vibration, flutter, and noise, and to afford an optimal engineering design. In a preferred embodiment, the fitting of essentially nonparallel interior walls around this largest circumference of the motor (5), is cylindrical or canister in shape. The snug or tight fit of the housing (FIG. 5) around most of the motor (5) in a cylindrical or canister fitting, makes the interior wall geometry of the half-housing (FIG. 5) further acoustically silenced, due to the snug or tight fitting of the elastomeric blower half-housing (FIG. 5), thereby minimizing further vibration and flutter, and absorbing some of the acoustical noise.

Another embodiment of the present invention utilizes a screen, prefilter, filter, or filter assemblies in the proximity of the intake opening (13), or in the proximity of the extended output opening (7), in order to filter out dirt, dust, carbon particles from the blower motor, and other undesired fluid or air impurities. The screen, prefilter or filter may be inserted, e.g., within the extended output opening (7) or may be fitted to the output flow piping. When inserted into, e.g. , the extended output opening (7), the screen, prefilter or filter may be easily replaced through the unfastening of the fastening member, and when the fastening member is a hose clamp (4), the loosening of one screw may make the removal or service of the screen, prefilter or filter quick and easy.

Another embodiment of the present invention utilizes additional sound dampening material or materials on a part of or on the entire surface of the nonparallel interior walls of the blower half-housing (FIG. 6), in order to further silence the noise and vibration emanating from the blower motor (5) and the fluid flow through the blower half-housing (FIG. 6). This additional sound dampening material may have the effect of offering additional support to the motor (5) and additionally may fill or partially fill the cavity or void space within the blower half-housing (FIG. 6). This embodiment may be particularly useful in, e.g., special acoustically silenced aeration and filtration devices and systems used, e.g., in homes and industry, where such silencing of acoustical noise may be critical.

Another embodiment of the present invention utilizes a muffler attached to the flow piping at the extended output opening (7), for additionally silencing the blower half-housing. The muffler may be attached or removed for service or replacement through the unfastening of the fastening member, and when the fastening member is a hose clamp (4), the loosing of one screw may make the removal or service of the muffler quick and easy.

Description of a Preferred Embodiment

A preferred embodiment of the blower half-housing (FIGS. 1, 3, and 5), which may be used in the spa industry, has the following approximate dimensions:

1) Electric Power Cable (1): sufficient length to reach power source and to have enough slack to provide for vibration and movement of the flow piping, as well as for safe and easy disassembly of the housing for service.
2) Hose Clamp (2), securing the power cable (1): approximately $\frac{5}{8}$ inch nominal.
3) Hose Clamp ((3), securing the blower motor (5) to the blower half-housing: approximately 6 and $\frac{3}{8}$ inches nominal.
4) Hose Clamp (4), securing output flow piping: approximately 2 and $\frac{3}{4}$ inches nominal.
5) Electric Blower Motor (5): often between one and two horsepower, in this embodiment as used in the spa industry.
6) Extended Cable Opening (6): outside diameter is approximately 0.625 inch.

7) Extended Output Opening (8), for output flow piping: inside diameter is approximately 2.355 inches in diameter.

8) Output Restraint Notch (8), for fitting and holding output flow piping into place: protruding approximately 0.15 inch.

9) Indented Output Fitting Area (9), for securing hose clamp onto part of housing holding the output flow piping: strip or band is approximately 0.062 inch deep.

10) Indented Housing Fitting (10), for fitting and securing blower motor (5) within the blower half-housing, through the use of a fastening means, such as a hose clamp: approximately 0.25 inch deep.

11) Male Housing Restraint Notch (11), for further securing the fastening member, such as a hose clamp, around the intake portion of the blower half-housing: protruding approximately 0.2 inch.

12) Intake Restraint Notch (12), for fitting and holding the blower motor (5) into place within the blower half-housing: protruding approximately 0.15 inch.

13) Extended Intake Opening (13), for holding the intake end of the blower motor (5): inside dimension is approximately 2.355 inches in diameter.

Another preferred embodiment, which may be used in the spa industry or in the air purification industry, has dimensions essentially similar to those in the above detailed, 13 item embodiment, except the extended output opening (7) has an inside diameter of approximately 1.55 inches.

While I have shown and described in this disclosure only selected embodiments in accordance with the present invention, it is understood that the same is not limited thereto, but is susceptible to numerous changes and modifications as known to one having ordinary skill in the art, and I therefore do not wish to be limited to the details shown and described herein, but intend to cover all such modifications, changes, additions, and eliminations, as are encompassed by the scope of the appended claims.

I claim:

1. A one-piece blower housing, suitable for housing a blower motor which blows fluids, including air, comprised of:

a. said one-piece blower housing with three openings: 1) an intake opening to receive a portion of the blower motor such that the intake of said motor would protrude from said intake opening, 2) an extended output opening to receive one end of the output flow piping, on the opposite end of said housing in relation to said intake opening, and 3) an extended cable opening to receive a portion of the electric power cable which is connected to said motor, b. a fastening means for securing and air-sealing said portion of said motor within said intake opening of said housing, c. a fastening means for securing and air-sealing said portion of said electric power cable within said extended cable opening and said housing, d. a fastening means for securing and air-sealing said output flow piping end within said extended output opening, e. an output restraint notch for restraining said output flow piping end from being inserted too deep into said housing, and f. an interior geometry of said housing, which consists of essentially nonparallel interior walls, and said walls may have a geometry which is spherical, the zone of a sphere, cylindrical, conical, the frustrum of a cone, or a combination of these geometries.

2. A blower housing, as recited in claim 1, wherein: said fastening means are suitably fitted hose clamps, or the like for air-sealing and securing:

a. needed portion of said electric power cable within said extended cable opening and said housing, b. needed portion of said output flow piping within said extended output opening, and c. needed portion of said blower motor within said intake opening and said housing.

3. A blower housing, as recited in claim 2, wherein said hose clamp or the like for setting and securing a portion of said motor within said housing is further set and secured in place with:

a. a male housing restraint notch, which is located on the edge and around the external perimeter of said intake opening.

4. A blower housing, as recited in claim 3, wherein said hose clamps or the like are further set and secured in place with:

a. an indented housing fitting around the external surface of said housing and adjacent to said mate housing restraint notch, for setting and securing said hose clamp around external perimeter of said intake opening, and b. an indented output fitting area near said extended output opening, for setting and securing said hose clamp or the like around the external perimeter of said extended output opening.

5. A blower housing, as recited in claim 1, wherein said housing is composed of a material selected from the group of materials known as polymeric or elastomeric materials.

6. A blower housing, as recited in claim 4, wherein said housing is composed of a material known as neoprene, and which is between 60 and 70 Shore in hardness.

7. A one-piece blower housing, suitable for housing a motor which blows fluids, comprised a. said one-piece blower housing with openings to: 1) receive a portion of the blower motor such that the intake of said motor would protrude from said housing, 2) receive one end of the output flow piping, on the opposite end of said housing in relation to the location of the motor's protruding intake end, and 3) receive a portion of the electric power cable which is connected to said motor, b. a fastening means for securing a portion of said motor within said housing, c. a fastening means for securing said portion of said electric power cable within said housing, d. a fastening means for securing said portion of said output flow piping end within said housing, and e. an interior geometry of said housing, which consists of essentially nonparallel interior walls, and said walls may have a geometry which is spherical, the zone of a sphere, cylindrical, conical, the frustrum of a cone, or a combination of these geometries.

8. A blower housing, as recited in claim 7, wherein said fastening means are hose clamps or the like.

9. A blower housing, as recited in claim 7, wherein said housing is composed of a material selected from the group materials known as polymeric or elastomeric materials.

10. A blower housing, as recited in claim 7, wherein said housing is composed of a material known as neoprene, and which is between 60 and 70 Shore in hardness.

11. A blower housing, as recited in claim 7, wherein there is an output restraint notch for restraining said output flow piping from being inserted too deep into said housing.

12. A blower housing, as recited in claim 7, wherein said fastening means for securing a portion of said motor within said housing is further secured in place with a male housing restraint notch, which is located on the edge and around the external perimeter of the intake opening of said housing.

13. A blower housing, as recited in claim 8, wherein said hose clamps are further secured in place with 1) an indented housing fitting around the external surface of said housing, for further securing the hose clamp around the external perimeter of said housing's intake opening, and 2) an indented output fitting area near the extended output opening, for further securing the hose clamp around the external perimeter of said extended output opening.

* * * * *